United States Patent [19]

Mowbray

[11] Patent Number: 4,474,158

[45] Date of Patent: Oct. 2, 1984

[54] LIQUID FUEL PUMPING APPARATUS

[75] Inventor: Dorian F. Mowbray, Burnham, England

[73] Assignee: Lucas Industries Public Limited Company, Birmingham, England

[21] Appl. No.: 437,466

[22] Filed: Oct. 28, 1982

[30] Foreign Application Priority Data

Nov. 11, 1981 [GB] United Kingdom ..... 8134041

[51] Int. Cl.[3] ..... F02M 39/00

[52] U.S. Cl. ..... 123/458; 123/459; 123/462; 123/506; 123/460

[58] Field of Search ..... 123/506, 458, 459, 462, 123/446, 447, 460

[56] References Cited

U.S. PATENT DOCUMENTS

| | | | |
|---|---|---|---|
| 1,664,610 | 4/1928 | French | 123/458 |
| 3,662,721 | 5/1972 | Klein | 123/462 |
| 3,779,225 | 12/1973 | Watson | 123/458 |
| 4,327,696 | 5/1982 | Kobayashi et al. | 123/506 |
| 4,351,283 | 9/1982 | Ament | 123/506 |
| 4,395,987 | 8/1983 | Kobayashi et al. | 123/506 |

*Primary Examiner*—Magdalen Y. C. Moy

[57] ABSTRACT

A liquid fuel pumping apparatus for supplying fuel to an internal combustion engine includes a high pressure pump 10 having an outlet 13 for connection in use to an injection nozzle. Fuel is supplied by a low pressure pump to the high pressure pump and the amount of fuel delivered through the outlet is controlled by a spill valve 19 which is electrically controlled. In the event of failure of the spill valve 19 in the control system 24 which controls the valve, the valve is arranged to move to the open position. In order to allow further operation of the associated engine valve means including a valve member 40 which can be moved to an operative position, is provided, the valve means prevents flow of fuel through the spill valve and also throttles the fuel supply to the high pressure pump thereby allowing a limited fuel supply to the associated engine.

5 Claims, 1 Drawing Figure

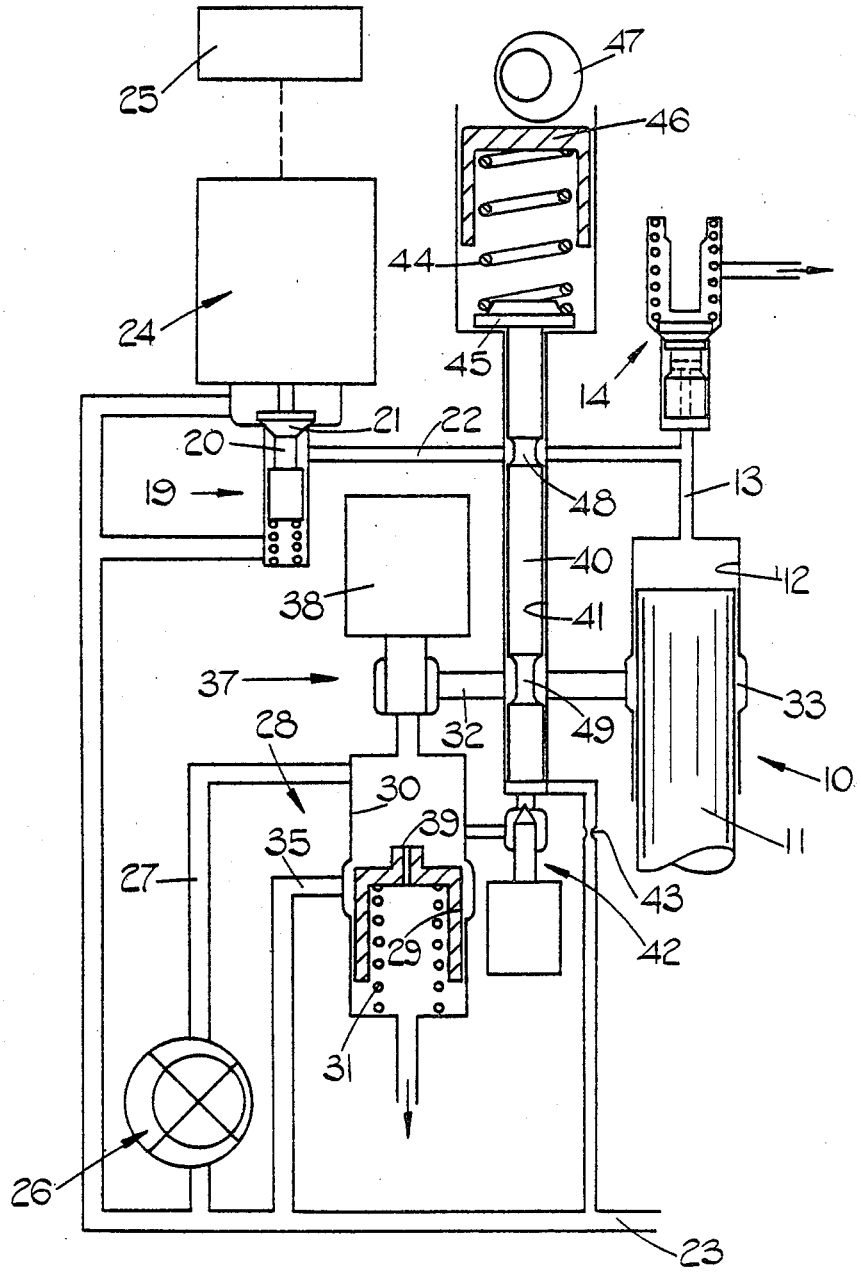
25
47
46
44
24
45
14
21
22
20
19
48
13
40
12
38
41
37
33
28
32
49
10
30
39
35
11
27
43
42
29
31
26
23

LIQUID FUEL PUMPING APPARATUS

This invention relates to a liquid fuel injection pumping apparatus for supplying fuel to an internal combustion engine and of the kind comprising a plunger reciprocable within a bore, an outlet from the pumping chamber defined by the plunger and the bore, said outlet in use, communicating with a fuel injection nozzle of an associated engine, a spill passage communicating with the bore and an electrically controlled spill valve in said passage whereby when the plunger is moved inwardly the amount of fuel which flows through said outlet can be controlled by operation of said valve and passage means through which fuel can be supplied to said bore.

Apparatus of the aforesaid type in which the spill valve is mechanically operated is well known. The advantage of using an electrically controlled valve, the operating signals to which will be provided by an electronic control system is the improved overall control of the fuel supply to the engine which can be obtained. A disadvantage is that the electrically operated spill valve and/or the associated control system are more susceptible to failure. When failure occurs it is arranged that the spill valve moves to the open position in order to prevent the maximum flow of fuel to the engine such as would occur if the valve failed in the closed position. As a result no fuel will be supplied to the engine. This method of protection is ideal so far as the engine is concerned but since it results in a complete loss of power, it can cause practical difficulties particularly when the engine is used to power a road vehicle.

It is an object of the present invention to provide an apparatus of the kind specified in a form in which following failure of the spill valve and/or the associated control system, a limited flow of fuel can be supplied through the outlet.

According to the invention an apparatus of the kind specified comprises a valve means including a valve member movable from an inoperative position to an operative position, said valve member in the operative position preventing flow of fuel through said spill passage and also defining throttle means in said passage means, said valve means further including an actuating means operable to cause movement of said valve member from the inoperative to the operative position.

An example of apparatus in accordance with the invention will now be described with reference to the accompanying drawing in which the apparatus is shown in diagrammatic form.

Referring to the drawing, the apparatus comprises a high pressure pump generally indicated at 10 and which includes a plunger 11 which is reciprocably mounted within a bore 12. The plunger is actuated by means of a cam not shown, which is mounted upon a shaft driven by the associated engine. The plunger 11 is moved inwardly to reduce the volume of the pumping chamber defined by the plunger and the bore, each time fuel is required to be delivered to the associated engine. Communicating with the bore 12 is an outlet passage 13 in which is located a conventional form of delivery valve 14 and the passage 13 may communicate with a high pressure distributor so that fuel can be supplied to a number of outlets in turn, the outlets in use, being connected to the injection nozzles of the associated engine.

The quantity of fuel which is supplied to an outlet is determined by a spill valve which is generally indicated at 19 and which includes a slidable valve member 20 having a head 21 which can co-operate with a seating formed in the valve housing. The spill valve is located in a spill passage 22 and in the open position connects the outlet passage 13 upstream of the delivery valve 14, with a spill outlet 22 which returns the spilled fuel to a fuel inlet 23. The spill valve 19 is controlled by an electromagnetic device generally indicated at 24, the valve member 20 being spring biased to the open position. The operation of the device 24 is controlled by an electronic control system indicated in outline at 25.

The apparatus also includes a low pressure pump generally indicated at 26 which has a fuel inlet connected to the inlet 23, and an outlet 27. The apparatus also includes an accumulator generally indicated at 28 and this includes a piston 29 which is slidable within a chamber 30. The piston is resiliently loaded by means of a coiled compression spring 31 in a direction to reduce the volume of the chamber. The outlet 27 of the low pressure pump is in permanent communication with the chamber 30 and the latter also has an outlet passage 32 which communicates with a groove 33 formed in the wall of the bore 12. Fuel can flow from the groove 33 into the pumping chamber to completely fill the pumping chamber when the groove is uncovered by the plunger during the outward movement thereof.

The pump 26 may be of the vane type which delivers fuel through the outlet 27 has an input shaft which is coupled to a rotary part of the engine and which conveniently carries the cam associated with the plunger 11, is rotated.

A spill port or groove 35 is provided in the wall of the chamber and is uncovered to the chamber when the piston 29 has moved a predetermined amount against the action of the spring 31. The spill port 35 is connected to the inlet of the low pressure pump. The piston 29 in conjunction with the spill port 35 and the spring 31, determine the maximum fuel pressure in the chamber 30. In operation, when the plunger 11 has moved outwardly to uncover the groove 33, fuel flows from the accumulator to fill the pumping chamber of the high pressure pump. During the flow of fuel the piston 29 will move under the action of the spring 31, to ensure proper filling of the pumping chamber. As the plunger 11 moves inwardly the groove 33 is covered and fuel is displaced from the bore 12 along the outlet passage 13. Depending upon the position of the spill valve 19, the fuel either flows through the spill passage 22 or to a high pressure outlet by way of the delivery valve. While fuel is being supplied by the high pressure pump, the continued flow of fuel from the low pressure pump displaces the piston 29 against the action of the spring 31 so that the accumulator is recharged.

A stop valve 37 is provided in the passage 32, the valve being actuated by an electromagnetic device 38 whereby the flow of fuel to the high pressure pump 10 can be interrupted when it is required to stop the engine. The piston 29 of the accumulator is provided with a restricted orifice 39 and through which fuel can flow from the chamber 30 to a drain. The purpose of the orifice 39 is to try to ensure that any air which collects in the accumulator is returned to the drain which may be the fuel supply tank, and is not supplied to the high pressure pump.

The apparatus also includes valve means comprising a slidable valve member 40 which is housed within a bore 41. One end of the bore 41 communicates with the chamber 30 by way of a solenoid operated valve 42 which during normal operation of the apparatus is closed. In addition, this end of the bore communicates with the inlet of the low pressure pump by way of a restricted orifice 43. The valve member is biased towards the one end of the bore 41 in which it is in its inoperative position, by means of a coiled compression spring 44. The spring 44 is positioned between an abutment 45 which is carried upon the valve member 40 and a movable abutment 46 the position of which is adjustable by means of a cam 47 which is connected to the throttle pedal of the associated engine.

The bore 41 is intersected at two axially spaced positions, by the passage 32 which connects the stop valve 37 with the groove 33 and by the spill passage 22 which connects the spill valve 19 with the passage 13. The valve member 40 is provided with the two circumferential grooves 48 and 49. Both grooves are positioned when the valve member is in the inoperative position, so that there is substantially no restriction to the flow of fuel along the two passages which they control. However, in the event of failure of the control system 25 or the device 23, the valve 42 is opened to allow fuel under pressure from the chamber 30 to act upon one end of the valve member 40 to move the valve member against the action of the spring 44 to the operative position. This movement moves the groove 48 out of register with the ports associated therewith and hence prevents flow of fuel along the spill passage 22 through the open spill valve 19. In addition, the circumferential groove 49 moves to restrict the flow of fuel from the chamber 30 to the groove 33. The valve member 40 therefore acts as a conventional form of throttle to restrict the rate at which fuel can flow to the high pressure pump. The pressure in the chamber 30 does vary with speed and as the speed increases so also does the pressure applied to the valve member 40 so that the latter will move to further restrict the flow of fuel to the pressure pump. As a result the speed of the associated engine will be governed. If the operator requires an increase in the flow of fuel to the engine the abutment 46 is moved to increase the force exerted by the spring 44 and vice versa.

It is arranged that the performance of the engine which can be obtained when the additional valve member is in its operative position, is lower than when the control system is operating normally. In this manner, the operator of the engine will be aware that the control mode has changed, and hence seek to obtain a new unit rather than continue with the low power available.

The purpose of the restrictor 43 is to allow when the valve 42 is closed for normal operation, the valve member 40 to move under the action of the spring 44 to the inoperative position in which it is shown in the drawing, and in which substantially no restriction to the flow of fuel either to the high pressure pump or by way of the spill valve 19 occurs. The restrictor 43 also acts to ensure that sufficient pressure is available when the valve 42 is open, to move the valve member 40 against the action of the spring 44.

I claim:

1. A liquid fuel injection pumping apparatus for supplying fuel to an internal combustion engine comprising a plunger reciprocable within a bore, an outlet from a pumping chamber defined by the plunger and the bore, said outlet in use, communicating with a fuel injection nozzle of an associated engine, a spill passage communicating with the bore and an electrically controlled spill valve in said passage whereby when the plunger is moved inwardly the amount of fuel which flows through said outlet can be controlled by operation of said valve, passage means through which fuel can be supplied to said bore, valve means including a valve member movable from an inoperative position to an operative position, said valve member being of cylindrical form and being slidable in a complementary bore, said valve member having a pair of spaced circumferential grooves thereon, said complementary bore intersecting said spill passage and said passage means at a position corresponding to the grooves of the valve member, said valve member in the operative position, preventing flow of fuel through said spill passage and also defining throttle means in said passage means, resilient means for biasing said valve member to the inoperative position, and said valve means further including a valve which can be opened to allow fuel under pressure to act on the valve member to move the valve member from the inoperative to the operative position against the action of said resilient means.

2. An apparatus according to claim 1 including a low pressure supply pump, means for controlling the output pressure of said supply pump so that it varies in accordance with the speed of operation, the fuel under pressure for effecting movement of the valve member being obtained from the outlet of said supply pump.

3. An apparatus according to claim 1, including manually operable means for varying the force exerted by said resilient means on the valve member whereby the position of said valve member will depend upon the speed at which the apparatus is driven.

4. An apparatus according to claim 1, including a restricted passage means through which fuel can be displaced at a restricted rate by the valve member during its movement to the inoperative position following the closure of the valve.

5. A liquid fuel injection pumping apparatus for supplying fuel to an internal combustion engine comprising a plunger reciprocable within a bore, an outlet from a pumping chamber defined by the plunger and the bore, said outlet in use, communicating with a fuel injection nozzle of an associated engine, a spill passage communicating with the bore and an electrically controlled spill valve in said passage whereby when the plunger is moved inwardly the amount of fuel which flows through said outlet can be controlled by operation of said spill valve, passage means through which fuel can be supplied to said bore, a valve member movable from an inoperative position to an operative position, said valve member in the operative position preventing the flow of fuel through said spill passage and also defining throttle means in said passage means, resilient means biasing the valve member to the inoperative position, manually operable means for varying the force exerted by said resilient means and an on/off valve which can be opened to allow fuel under pressure to act on said valve member to move the valve member to the operative position, said throttle means in the operative position controlling the flow of fuel to said bore in an amount depending on the force exerted by said resilient means.

* * * * *